United States Patent [19]

Duke

[11] Patent Number: 4,478,063

[45] Date of Patent: Oct. 23, 1984

[54] HOT-ROLLING MILL AND METHOD

[75] Inventor: John C. Duke, Hickory, N.C.

[73] Assignee: Southwire Company, Carrollton, Ga.

[21] Appl. No.: 332,052

[22] Filed: Dec. 18, 1981

[51] Int. Cl.[3] ..... B21B 27/10

[52] U.S. Cl. ..... 72/42; 72/46; 72/236

[58] Field of Search ..... 29/132; 72/42, 46, 199, 72/234, 236, 365, 366; 252/49.5

[56] References Cited

U.S. PATENT DOCUMENTS

| | | | |
|---|---|---|---|
| 2,791,525 | 5/1957 | Rausch et al. | 72/46 X |
| 3,556,867 | 1/1971 | Glasson | 72/46 X |
| 4,106,319 | 8/1978 | Linne | 72/366 X |
| 4,193,823 | 3/1980 | Linne | 72/234 X |

FOREIGN PATENT DOCUMENTS 988073 4/1965 United Kingdom .

OTHER PUBLICATIONS

Published Abstract 37,498, "High Pressure Lubricant and Method of Using Same", Nov. 1951, Schuster et al.

*Primary Examiner*—E. Michael Combs
*Attorney, Agent, or Firm*—Herbert M. Hanegan; Michael C. Smith; Robert S. Linne

[57] ABSTRACT

Apparatus and method for hot rolling metal between a plurality of roll stands having work rolls with nonpolar surfaces lubricated by a nonpolar lubricant.

12 Claims, No Drawings

HOT-ROLLING MILL AND METHOD

TECHNICAL FIELD

The present invention relates generally to hot rolling of metal, and particularly to a method of lubricating and reducing wear of the work rolls of a hot-rolling mill.

BACKGROUND ART

Rolling mills for hot-rolling metal are well known in the art. Examples are shown in U.S. Pat. Nos. 3,257,835, 3,317,994, 3,296,682, 3,517,537, 3,672,199, 3,766,763, 3,881,336, 3,881,337, 4,087,898, 4,106,319, 4,159,633 and 4,193,823. Such rolling mills normally roll metal stock such as bar or rod between pairs of smooth finished work rolls in tandem roll stands. The work rolls are usually made of a tool steel selected from the following AISI classes: the chromium hot work tool steels H11 through H16, the tungsten hot work tool steels H20 through H26 and the molybdenum hot work tool steels H41 through H43. It is preferred that the work rool material be selected from chromium hot work tool steels H11 to H16 because of their ability to resist heat softening during continuous exposure to high temperatures. While the industry normally employs smooth finished work rolls, a textured work roll of this type tool steel is disclosed in U.S. Pat. No. 4,193,823.

Many types of lubricants have been developed for lubricating the surfaces of the work rolls in a hot rolling mill to reduce roll wear due to abrasion. The lubricants are combined with water to form a coolant-lubricant system which cools the hot metal rod while lubricating the surfaces of the work rolls. These lubricants are conveniently divided into two major groups: (1) those which form heterogeneous aqueous mixtures, i.e. more than one phase; and (2) those which form homogeneous aqueous solutions or apparent solutions, i.e. one phase.

Lubricants of group (1) are normally thought to have relatively low lubricity and relatively low wetting ability. They also are nonpolar and thus must be synthetically suspended in water (which is polar) by emulsifying agents. Group (1) lubricants are therefore normally referred to in the art as oil-in-water emulsion lubricants.

Oil-in-water emulsion lubricants form a suspension of lubricant material in water, are milky white in color, and are opaque. The lubricant base is normally refined mineral oil to which are added an emulsifier agent and detergent, so that the lubricant will form tiny, suspended droplets of various diameters when mixed with or added to water. Typical brand names of examples of this type lubricant are Dromus B, Prosol 68, and Soluble Oil D. Since emulsion lubricants are least expensive, conventional oil-in-water emulsion systems have long been attractive from a cost standpoint and generally preferred in high volume, high make-up systems. When used for cooling lubrication in mild to medium duty applications, oil-in-water lubricants are usually found to be an acceptable choice. In extreme pressure, high temperature service such as hot rolling, satisfactory lubrication and extended roll life are in jeopardy because the typical oil-in-water lubricant is subject to failure. As previously mentioned, this type lubricant mixture is comprised of minute droplets of non-uniform size and held in water suspension by the action of emulsifier agents. The ability to lubricate metal surfaces by the usual means thereby becomes dependent on sufficient numbers of these lubricant droplets transferring from the water carrier medium and attaching themselves to all parts to be lubricated or, more specifically, the smooth finished roll work surfaces. Furthermore, it is established that this ability to "plate out" or "wet" smooth finished metal surfaces is not shared by all lubricant droplets but is characteristic of only a few whose physical size fall within a relatively narrow range of diameters. In general, of the total lubricant content expressed as per cent volume of the working emulsion, only a very small amount is actually beneficial in reducing roll wear. High temperature, dissolved metal ions, hard water ions, gear box lube contamination, mechanical shear forces, and improper pH control are all forces which act to segregate the size of droplets to levels outside the range which is known to be useful. Considering the above description of lubricant dispersion in water, the mechanics of lubricant transfer to metal surfaces, and the comparatively low lubricant potential available even under conditions thought to be ideal in the prior art; oil-in-water emulsion systems have been considered by the industry to be inadequate in providing lubrication and roll life improvement. A better alternative was thought to be found in the more expensive water miscible rolling lubricant of group (2).

Group (2) lubricants are either soluble in water or naturally disperse in water into colloidal particles or droplets generally from about 10 angstroms to about 20,000 angstroms in size. Since lubricants of group (2) are actually or apparently miscible in water, they are referred to in the art as miscible or true solution lubricants. These lubricants are polar, have relatively high lubricity and have relatively high wetting ability.

Water miscible lubricants form clear or slightly turbid solutions or mixtures with water. The lubricant base is normally composed of long chained organic compounds such as fatty acids and may also contain various surface active agents such as amine compounds. These materials will disperse themselves uniformly in water as molecular "bits" of patent lubricant compound. Typical brand examples of this type lubricant are Quakerol, and Lube-Well HR. Comprised mainly of synthetic organic ester materials or long chained fatty acids, these polar lubricants have the inherent chemical ability of dividing themselves into molecular "bits" which are normally strongly attracted to metal surfaces which are also polar. Because the water solutions of these lubricants are not dependent on emulsifier agents for controlling various physical and chemical properties, they are generally able to carry out their function of lubrication unaffected by most of the physical extremes of hot rolling. The ability of these polar lubricants to become adsorbed onto the surface of metals is discussed by Douglas Godfrey in Chapter 2 of the *Standard Handbook of Lubrication Engineering* and by Stanislav N. Postnikov in Chapter 3 of *Electrophysical And Electrochemical Phenomena In Friction, Cutting, And Lubrication.* It is believed that smooth finished metal surfaces have considerable free energy and polar lubricant molecules are attracted thereto and align generally perpendicular to the metal surface closely together forming a film characterized by high boundry lubricity. Being surface active in nature, it was generally assumed by the industry that boundary film lubrication is dominant and that the additional benefit of roll surface passivation against high temperature oxidation was possible. When used in a hot rolling mill coolant and lubricant system, however, the polar lubricants are mixed with water which is also polar and thus molecules of polar lubricant must compete with molecules of water for space at the surface of the metal work roll, which detracts from boundry lubricating effectiveness. Roll life improvements over conventional oil-in-water systems were realized by the industry with the use of miscible lubricant systems which helped justify the increase in lubrication cost. However, polar lubricants also have limited usefulness in high temperature applications because the polarity induced boundry film is destroyed by extreme heat.

The industry trend has been toward the use of rolling lubricants that form miscible solutions or mixtures in water which are thought to be normally better able to perform the vital role of lubrication because the industry has assumed that they are less subject to influences which inhibit lubrication of metal surfaces than oil-in-water emulsions. The present invention provides means for increasing the lubricating efficiency of oil-in-water emulsion systems to a level exceeding that of conventional miscible solution systems.

DISCLOSURE OF INVENTION

The purpose of using hot rolling mill coolant-lubricant systems is to effectuate a number of the benefits which can only be achieved by the use of lubricants. Effective lubrication during the hot rolling of metals materially increases roll life, thereby reducing the number of roll changes and mill downtime. This results in increased production at lower costs. Proper lubrication minimizes metal pickup and loss of metal from the rolls to the workpiece and vice versa as the workpiece travels through the various stands of the rolling operation. Proper lubrication during the hot rolling of metal gives an improved product surface quality due to the improved surface condition of the work rolls, and a reduction of roll grinding requirements during refurbishing is also achieved.

The present invention employs the method disclosed herein of lubricating work rolls, having textured nonpolar surfaces formed by conversion coating, with inexpensive nonpolar oil-in-water emulsion lubricants. A work roll having suitable conversion coating surfaces, is provided which chemically and physically secures effective quantities of oil-in-water emulsion lubricants, having relatively low lubricity, from the water carrier without positively attracting molecules of water to provide a more effective and inexpensive work roll lubrication system than is provided in the conventional smooth finished polar work roll and miscible polar lubricant system. Additional advantages of this invention over miscible lubricant systems include more effective heat transfer to the coolant water and the ability of the oil-in-water emulsion lubricant droplets to carry off particulates for removal by a mixture filtration system.

This invention makes it possible to promote improved conditions for lubrication of work rolls through simple metallurgical and chemical means whereby the nonpolar lubricants are naturally absorbed and carried on the textured nonpolar wear surfaces of rolls. This invention surpasses lubricating requirements which lubricant suppliers and users normally achieve only by expensive physical and chemical enrichments of their lubricant products. Also, this invention simplifies design of lubricant application systems since these efforts are usually undertaken to compensate for failings on the part of the lubricant industry in advancing the state of the art in improving the performance in their products. Advantages are: improved roll life with existing lubricant systems; roll corrosion inhibition during periods of storage; and pre-lubrication of rolls to avoid any undue wear and abrasion on dry start-ups in the metal rolling process.

It is therefore one purpose of this invention to provide a method of improved roll lubrication and reduced roll wear by the inclusion of suitable conversion coatings processing as a post treatment in the fabrication of mill rolls and use of oil-in-water emulsion lubricants.

Thus a major objective of this invention is to provide a a hot rolling mill and a method for lubricating work rolls of a rolling mill used in the hot-rolling of metal by providing a textured nonpolar conversion coating surface on the work rolls which physically and chemically secures effective amounts of droplets of the nonpolar oil-in-water emulsion lubricant from the water carrier.

Another object is to provide more effective lubrication than is available in conventional smooth finished work roll and miscible lubricant systems.

Still another object of the present invention is to provide a less expensive method of lubrication.

Another object is to provide a lubrication system which is characterized by more effective cooling ability.

A further object is to provide a lubrication system having the ability to more effectively carry off particulates for removal by a mixture filtration system.

BEST MODE FOR CARRYING OUT THE INVENTION

Nonpolar conversion coatings formed on tempered work roll surfaces pursuant to this invention are principally phosphates, chromates, oxides, or combinations thereof. These "corrosion products" are preferably formed under carefully controlled conditions. For example, black oxide coatings or the like are formed on tempered tool steel work roll surfaces by immersion in very strong alkaline solutions containing oxidizing agents such as nitrites, nitrates, chlorates or combinations thereof. Coatings formed by this treatment are largely magnetic oxide, are about 0.00003 to 0.00007 inch thick and are an integral part of the parent work roll material. Chief attributes of such coatings are resistance to physical abrasion and providing a superior base for oil-in-water lubricants. The small dimensional change resulting from the oxidation permits the treatment of precision parts and is well within the range permitted for rolling mill work rolls. A more detailed explanation of phenomena relating to roll wear and lubrication is needed in order to realize the significance of this invention.

When surfaces of work rolls and metal stock are placed in contact, they do not usually touch over the whole of their apparent area of contact. In general, they are supported by surface irregularities which are present even on the most carefully prepared surfaces. Even small loads produce plastic flow of the regularities at these regions of contact and the asperities crush down until they are large enough to support the load. Metallic junctions are often temporarily formed at the regions of real contact by a process of welding, and these junctions formed between the mill rolls and rod stock are sheared subsequently by the relative motion of rolling. The immediate consequence of this welding and shearing action, as it applies to hot rolling of rod stock, is that work roll surfaces are worn by the progressive removal of work roll surfaces material, rod quality is diminished as ferrous material becomes imbedded beneath the rod surface, and working life of work rolls is reduced as rod stock material becomes adherent to the surface of the rolls and geometry of the rolling pass is distorted. The introduction of suitable lubricants to effect a separation of the contacting surfaces between rolls and rod is important to reduce the effects of welding-shearing of loaded and load carrying surfaces in terms of usuable roll life and rod quality. Lubricant suppliers have attempted to capitalize on the abilities of certain organic materials to become inherently attached to the surfaces of the rolls by chemical actions of polar activity. Typical materials of this type are natural palm and rapeseed oils. These natural oils and their synthetic counterparts are expensive, and their lubricity performance will usually deteriorate with the increased temperatures typical of hot rolling. More inexpensive lubricants for hot rolling applications are based on nonpolar petroleum mineral oils in conjunction with emulsifiers, which together provide only minimal lubrication because their synthetically induced wetting and attraction to the conventional roll surfaces is soon lost due to contamination. The arrangement and position of lubricant sprays relating to the roll surfaces is not always remedial in compensating for the inability of such lubricants to be attracted to and carried on the surface of the rolls.

The detriments of improper or ineffective roll lubrication are partially offset by the promotion of conversion coatings such as metal oxides on the work roll surfaces. Typically, the junctions formed in the oxide film are weaker than purely metallic junctions so that the friction is appreciably less when the oxide is ruptured. Since the shearing process occurs within the oxide film, the surface damage and wear are always considerably reduced. Another advantage is that any surface contacts between rod and work roll are interfaced with oxides, i.e., oxide carried on the rod surface and oxide applied to the roll surface through the process of conversion coating. This substantially reduces the number of welded metallic junctions and shearing actions associated with wear of the roll surfaces and build-up distortion in the roll pass. This benefit has wider ranged implications when considered with the inclusion of reducing gas environments in hot rolling.

While the Applicant does not wish to be bound by any particular theory, it is believed that the establishment of nonpolar conversion coatings on the work roll surfaces provide for the physical and chemical retention of lubricant. Polar as well as nonpolar lubricants may be employed in this system; however, the polarity bond thought to exist between the molecules of polar lubricants and smooth finished polar metal surfaces is nonexistant thus eliminating the lubricity advantage which polar lubricants enjoy over nonpolar lubricants in the conventional smooth finished work roll systems. In addition, the use of nonpolar surfaced work rolls eliminates the competitiveness of water trying to reach the roll surface. By employing nonpolar lubricant in a polar carrier (water) to lubricate nonpolar work rolls, it appears that some attraction between the nonpolar rolls and the nonpolar lubricant results. It is believed that this apparent attraction between the two theoretically indifferent bodies is actually an absence of propensity to repel, coupled with high stability once joined. The preferred lubricant is a nonpolar lubricant because it appears that the nonpolar lubricants are the most suitable for retention by the conversion coating and because such lubricants are relatively inexpensive. Use of nonpolar lubricant with a nonpolar roll surface precludes interference by the polar carrier, water, by eliminating the usual polarity attraction between the roll and the water, thus providing for more uniformity of lubricant attachment to the conversion coating. It is believed that nonpolar lubricant molecules tend to attach themselves generally parallel to the surface of the work roll because of the absence of polarity and because of the absence of an attractive free energy finished metal surface. Irregularity of the conversion coating surface captures the nonpolar lubricant molecules forming a lubricant interface coincident with the conversion coating between the parent metal of the work roll and the metal stock being rolled. This method of interface lubrication results in improved apparent lubricity by oil-in-water emulsion systems. In addition, application of some lubricant immediately after formation of the conversion coating inhibits corrosion of the work roll and thus extends shelf life substantially. Further, prelubrication of these work rolls avoids undue wear and abrasion during start-up with new work rolls by eliminating the possibility of an inadvertant dry start-up. While polar lubricants adsorb onto the surface of finished metal work rolls, nonpolar lubricants adsorb onto the surface of nonpolar work rolls and absorb into the conversion coating of nonpolar work rolls.

The nonpolar lubricant employed is characterized by: napthemic mineral oil base; liquid weight of about 7.8 lbs/gal; pH of about 9.5; and viscosity of from about 100 to about 400 SSU at 100° F.

The textured nonpolar conversion coated work roll employed herein differs significantly from the textured work rolls disclosed in U.S. Pat. Nos. 4,106,319 and 4,193,823. Those work rolls are particularly adapted for high temperature applications such as break down and intermediate roll stands where rolling speeds are relatively slow and lubrication is less important. Such work rolls have hardened, thick, coarse layers of alloy oxide which are formed during the initial heat treatment of the roll and which physically resist wear irrespective of the lubricant used. In addition, the thick layers of hardened oxides resist heat damage by providing a thick insulating layer at the surface of the roll. The rate of slippage in the finishing rolls is about the same as the rate of shippage in the larger and slower breakdown and intermediate work rolls, but the substantial increase in finishing roll speed magnifies the slippage and thus creates a need for better lubrication. In addition, the metal rod has cooled considerably while traveling from the breakdown stage to the finishing stage thus decreasing the need for temperature resistance. Thus, while lubricity, inherent physical resistance to wear, and resistance to heat damage are important factors throughout the rolling mill, need for physical resistance to wear increases from the breakdown end to the finishing end, need for resistance to heat damage increases from the finishing end to the breakdown end, and need for lubrication increases from the breakdown end to the finishing end.

In constrast, the work roll coating of the present invention is a thin, fine textured, nonpolar layer which is chemically formed on the surface of a pre-hardened roll. By delaying formation of the coating until after hardening and finishing, the roll of the present invention is not susceptible to size change. Instead, the extremely small dimensional addition to the roll radius of about 0.00003 to about 0.00007 inch is uniform and is well within tolerances for work rolls. A related advantage is that the conversion coating of the present work roll can be ground off periodically and reapplied without additional heat treatment of the roll. In addition, by increasing lubricating efficiency, less hard work rolls may be used in order to reduce the possibility of roll cracking due to over hardening. While the rolling mill of U.S. Pat. No. 4,106,319 comprises minimum finishing work roll hardness of about 52 HRC (Hardness Rockwell "C"), intermediate work roll hardness of from about 49 HRC to about 52 HRC and breakdown work roll hardness of from about 43 HRC to about 49 HRC; finishing work rolls and intermediate work rolls of the present invention can be identically hardened to about 50 HRC to retain substantial hardness and decrease possibility of cracking while eliminating separate treatment of the two type rolls. It is preferred the breakdown rolls be kept at a hardness of from about 43 HRC to about 49 HRC.

The hardened tool steel work rolls are chemically treated to form thin, uniform, nonpolar conversion coating having fine texture and providing an ideal base for the retention of lubricants, preferably nonpolar lubricants. The polar water carrier for the nonpolar lubricant is thus specifically precluded from being attracted to the surface of the roll and thus does not interfere with attachment of lubricant molecules to the nonpolar surface.

This invention provides better lubrication and extended roll life as the result of creating more suitable substrates for lubrication, e.g. oxide films which absorb rolling lubricants, whether applied as neat, emulsions, or dispersions.

Selective and controlled application of conversion coatings, be they oxides, or chromates, or phosphates, or combinations of these, is an effective post fabrication procedure in mill roll manufacture for improving roll lubrication and subsequently reducing roll wear. The procedures for promoting conversion coatings are commercially available by typical hot blue or browning and other related methods often used by gunsmith and machine shops. Details of such methods are well known. Specific examples are discussed on pages 531 through 547 of volume 2 of *Metals Handbook,* Eighth Edition, and are specifically incorporated herein by reference.

The rolling mill of this invention will advantageously form metal. More particularly, non-ferrous metal rod is hot-formed by the rolling mill of this invention. Even more specifically, this rolling mill continuously hot-rolls copper rod for subsequent drawing into wire.

While this invention has been described in detail with particular reference to a preferred embodiment thereof, it will be understood that variations and modifications can be made effective within the spirit and scope of this invention as described hereinbefore and as defined in the appended claims.

INDUSTRIAL APPLICABILITY

This invention is capable of exploitation in the metal forming industry and is particularly useful in a rolling mill for continuously hot forming copper rod.

I claim:

1. A method of hot rolling non-ferrous metals in a rolling mill having a plurality of tandem roll stands each supporting work rolls comprising the steps of:

providing nonpolar conversion coating working surfaces on said work rolls of said roll stands containing products of corrosion selected from a group comprising phosphates, chormates, oxides and combinations thereof;

applying nonpolar naphtenic mineral oil lubricant to said nonpolar working surfaces; and hot rolling said metal while chemically and physically retaining said lubricant on said conversion coated nonpolar working surfaces.

2. The method of claim 1 wherein the step of providing nonpolar working surfaces comprises the step of:

applying akaline solution containing oxidizing agents onto the surface of a finished hot work tool steel work roll

3. The method of claim 2 wherein said oxidizing agents are selected from a group comprising: nitrites, nitrates, chlorates and combinations thereof.

4. The method of claim 2 wherein said conversion coating comprises a fine texture layer of black oxide from about 0.00003 inch to about 0.00007 inch thick.

5. The method of claim 1 wherein the step of applying lubricant comprises the steps of:

providing a mixture of nonpolar lubricant and water;

applying said mixture of nonpolar lubricant and water to said nonpolar working surfaces;

cooling said work rolls and said metal being rolled with said water; and lubricating said nonpolar working surfaces with said nonpolar lubricant.

6. The method of claim 1 wherein said nonpolar lubricant comprises: napthenic mineral oil base; liquid weight of about 7.8 lbs/gal.; pH of about 9.5; and viscosity of from about 100 to about 400 SSU at 100° F.

7. In a hot-rolling mill for the hot-working of non-ferrous metals of the type having a plurality of tandem roll stands having treated roll surfaces adapted to contact and deform non-ferrous metal in the presence of a water based cooling, lubricating solution wherein the improvement comprises the combination of a tempered hot work tool steel work roll having conversion coating working surfaces formed of corrosion products selected from a group comprising phosphates, chromates oxides and combinations thereof and a coating of nonpolar naphtenic mineral oil lubricant.

8. The apparatus of claim 7 wherein said nonpolar work roll surface comprises a fine textured black oxide conversion coating from about 0.00003 inch to about 0.00007 inch thick formed by contact of said work roll with alkaline solution containing oxidizing agents selected from a group comprising: nitrites, nitrates, chlorates and combinations thereof.

9. The apparatus of claim 7 wherein said nonpolar lubricant comprises: napthenic mineral oil base; liquid weight of about 7.8 lbs/gal; pH of about 9.5; and viscosity of from about 100 to about 400 SSU at 100° F.

10. The apparatus of claim 7 wherein said lubricant comprises mixtures of water and said nonpolar lubricant for cooling said work rolls.

11. The apparatus of claim 7 wherein the hardness of said work rolls is about 50 HRC.

12. The apparatus of claim 7 wherein said metal is copper rod.

* * * * *